US007726948B2

(12) United States Patent
Hunter et al.

(10) Patent No.: US 7,726,948 B2
(45) Date of Patent: Jun. 1, 2010

(54) HYDRAULIC PUMP WITH VARIABLE FLOW AND VARIABLE PRESSURE AND ELECTRIC CONTROL

(75) Inventors: Douglas G. Hunter, Troy, MI (US); Matthew J. Jannausch, Berkley, MI (US)

(73) Assignee: SLW Automotive Inc., Sallisaw, OK (US)

( * ) Notice: Subject to any disclaimer, the term of this patent is extended or adjusted under 35 U.S.C. 154(b) by 362 days.

(21) Appl. No.: 11/287,099

(22) Filed: Nov. 23, 2005

(65) Prior Publication Data

US 2006/0104823 A1 May 18, 2006

Related U.S. Application Data

(63) Continuation-in-part of application No. 10/406,575, filed on Apr. 3, 2003, now Pat. No. 7,018,178.

(51) Int. Cl.
*F04B 49/00* (2006.01)

(52) U.S. Cl. ..... 417/213; 417/212; 417/220; 418/26; 418/30; 418/31

(58) Field of Classification Search ..... 417/212, 417/220, 219, 213; 418/31, 30, 26
See application file for complete search history.

(56) References Cited

U.S. PATENT DOCUMENTS

| | | | | | |
|---|---|---|---|---|---|
| 2,716,946 | A | | 9/1955 | Hardy | |
| 2,799,995 | A | | 7/1957 | Herman | |
| 3,011,308 | A | | 12/1961 | Wotring | |
| 3,204,859 | A | | 9/1965 | Crooks | |
| 3,771,921 | A | * | 11/1973 | Rohde et al. | 417/12 |
| 3,918,855 | A | | 11/1975 | Bornholdt | |
| 3,924,970 | A | * | 12/1975 | Johnston et al. | 417/220 |
| 3,973,881 | A | | 8/1976 | Melchinger | |
| 4,014,305 | A | | 3/1977 | Skinner | |
| 4,035,105 | A | * | 7/1977 | Dantlgraber | 417/220 |
| 4,135,365 | A | * | 1/1979 | Budzich | 60/445 |
| 4,222,718 | A | | 9/1980 | Lemke | |
| 4,236,595 | A | | 12/1980 | Beck et al. | |
| 4,245,962 | A | * | 1/1981 | Uehara et al. | 417/218 |

(Continued)

FOREIGN PATENT DOCUMENTS

| | | |
|---|---|---|
| CA | 2 385 897 | 11/2003 |

(Continued)

*Primary Examiner*—Devon C Kramer
*Assistant Examiner*—Christopher Bobish
(74) *Attorney, Agent, or Firm*—Warn Partners, P.C.

(57) ABSTRACT

A pump system including a control system for controlling a variable flow pump for controlling oil flow and oil pressure in a hydraulic circuit in an engine. The system includes a pump member, an actuating member capable of controlling the flow generated by the pump member, and a solenoid valve system including a solenoid valve portion and a pressure regulator valve portion. The solenoid valve system is operably associated with the pump and the pressure regulator valve portion is operably associated with the actuating member for selectively controlling the flow generated by the pump member. An electronic control unit is operably associated with the solenoid valve portion, wherein the electronic control unit is selectively operable to provide an input control signal to the solenoid valve portion for controlling oil flow and oil pressure.

20 Claims, 3 Drawing Sheets

U.S. PATENT DOCUMENTS 4,259,039 A 3/1981 Arnold
4,292,805 A 10/1981 Acheson
4,325,215 A 4/1982 Yamamoto
4,328,480 A 5/1982 Keitel et al.
4,348,159 A 9/1982 Acheson
4,369,743 A 1/1983 Holt et al.
4,450,818 A 5/1984 Thoma et al.
4,468,173 A * 8/1984 Dantlgraber ..... 417/220
4,496,288 A 1/1985 Nakamura et al.
4,510,962 A 4/1985 Mott et al.
4,531,706 A 7/1985 Weiger et al.
4,531,898 A 7/1985 Ideta
4,538,974 A 9/1985 Stich et al.
4,606,313 A 8/1986 Izumi et al.
4,632,638 A 12/1986 Shibayama et al.
4,676,336 A * 6/1987 Hiramatsu et al. ..... 180/233
4,693,081 A 9/1987 Nakamura et al.
4,699,571 A * 10/1987 Bartholomaus ..... 417/213
4,710,106 A * 12/1987 Iwata et al. ..... 417/213
4,711,616 A 12/1987 Tsukahara et al.
4,738,330 A 4/1988 Suzuki et al.
4,740,142 A 4/1988 Rohs et al.
4,754,738 A 7/1988 Grohn et al.
4,774,918 A 10/1988 Kurio et al.
4,803,969 A 2/1989 Hiereth et al.
4,825,692 A 5/1989 Rohs et al.
4,850,269 A 7/1989 Hancock et al.
4,905,807 A 3/1990 Rohs et al.
4,974,562 A 12/1990 Ishii et al.
4,976,230 A 12/1990 Voigt
5,017,098 A 5/1991 Hansen et al.
5,052,896 A 10/1991 Fischer et al.
5,063,895 A 11/1991 Ampferer
5,067,454 A 11/1991 Waddington et al.
5,078,233 A 1/1992 Oetting et al.
5,085,187 A 2/1992 Black
5,090,881 A 2/1992 Suzuki et al.
5,101,789 A 4/1992 Voigt et al.
5,105,679 A 4/1992 Voigt
5,141,418 A 8/1992 Ohtaki et al.
5,190,003 A 3/1993 Voigt
5,195,474 A 3/1993 Urata et al.
5,197,860 A 3/1993 Nishida et al.
5,239,885 A 8/1993 Voigt
5,273,020 A 12/1993 Hayami
5,303,551 A 4/1994 Lee
5,315,971 A 5/1994 Yamada
5,339,776 A * 8/1994 Regueiro ..... 123/196 CP
5,353,753 A 10/1994 McGrath et al.
5,355,851 A 10/1994 Kamiya
5,390,635 A 2/1995 Kidera et al.
5,398,505 A 3/1995 Oogushi et al.
5,404,855 A 4/1995 Yen et al.
5,435,698 A 7/1995 Phillips
5,465,699 A 11/1995 Voigt
5,467,843 A 11/1995 Esch et al.
5,484,271 A 1/1996 Stich
5,485,725 A 1/1996 Teraoka
5,490,770 A 2/1996 Oogushi
5,527,156 A 6/1996 Song
5,544,628 A 8/1996 Voigt
5,545,014 A 8/1996 Sundberg et al.
5,545,018 A 8/1996 Sundberg
5,588,504 A 12/1996 Spiegel et al.
5,618,165 A 4/1997 Larsson et al.
5,630,383 A 5/1997 Kidera et al.
5,690,479 A 11/1997 Lehmann et al.
5,752,815 A 5/1998 Müller
5,797,732 A 8/1998 Watanabe et al.
5,800,130 A * 9/1998 Blass et al. ..... 417/213
5,800,131 A 9/1998 Lehmann et al.
5,826,556 A 10/1998 Ruman et al.
5,863,189 A 1/1999 Sundberg et al.
5,904,126 A 5/1999 McKay et al.
5,918,573 A 7/1999 Killion
5,921,758 A 7/1999 Anamoto et al.
5,947,695 A * 9/1999 Nagaoka et al. ..... 417/213
5,996,541 A 12/1999 Voigt et al.
6,053,137 A 4/2000 Trzmiel et al.
6,065,433 A 5/2000 Hill
6,079,380 A 6/2000 Jorgensen et al.
6,131,539 A 10/2000 Thomas
6,155,797 A 12/2000 Kazuyoshi
6,183,210 B1 * 2/2001 Nakamura ..... 417/222.1
6,202,016 B1 3/2001 Stephenson et al.
6,216,651 B1 4/2001 Ishikawa et al.
6,408,975 B1 * 6/2002 Bishop et al. ..... 180/422
6,413,054 B1 7/2002 Geiger et al.
6,488,479 B1 12/2002 Berger
6,524,076 B2 2/2003 Konishi
6,530,752 B2 3/2003 Oba et al.
6,615,683 B1 9/2003 Voigt
6,669,439 B2 12/2003 Kardasz et al.
6,790,013 B2 * 9/2004 Hunter et al. ..... 417/220
6,896,489 B2 5/2005 Hunter et al.
2001/0032618 A1 * 10/2001 Ramseyer et al. ..... 123/446
2001/0036412 A1 * 11/2001 Konishi ..... 417/220
2002/0085923 A1 * 7/2002 Konishi ..... 417/213
2002/0192081 A1 * 12/2002 Okada et al. ..... 417/213
2005/0118033 A1 * 6/2005 Schneider ..... 417/213

FOREIGN PATENT DOCUMENTS

DE 32 38 650 4/1984
DE 34 46 603 7/1985
DE 36 21 720 1/1987
DE 32 30 432 2/1987
DE 37 11 792 10/1987
DE 37 29 545 3/1988
DE 37 42 315 7/1988
DE 38 24 398 2/1989
DE 38 40 909 6/1989
DE 39 25 249 3/1990
DE 43 02 610 1/1993
DE 42 42 871 6/1994
DE 44 44 819 6/1996
DE 101 41 786 3/2003
DE 101 44 693 3/2003
DE 40 38 549 7/2003
DE 102 37 801 7/2003
EP 1 076 164 2/2001
EP 1 130 262 9/2001
EP 1 316 683 6/2003
EP 1 350 930 10/2003
FR 2 597 546 10/1987
FR 2 673 676 9/1992
JP 62 294 790 12/1987
JP 80 14 164 1/1996
JP 2001 159395 6/2001
JP 2001 173575 6/2001
JP 2001 294166 10/2001
WO WO 01/55597 8/2001
WO WO 01/79703 10/2001
WO WO 03/058071 7/2003

* cited by examiner

HYDRAULIC PUMP WITH VARIABLE FLOW AND VARIABLE PRESSURE AND ELECTRIC CONTROL

CROSS-REFERENCE TO RELATED APPLICATIONS

The instant application is a continuation-in-part of U.S. patent application Ser. No. 10/406,575, filed Apr. 3, 2003, which claims priority to U.S. Provisional Patent Application Ser. No. 60/369,829, filed Apr. 3, 2002, the entire specifications of both of which are expressly incorporated herein by reference.

FIELD OF THE INVENTION

The present invention generally relates to the control of the output of a variable flow pump, and more specifically to control systems for an oil pump for oil pressure control in an internal combustion engine, transmission, and/or the like.

BACKGROUND OF THE INVENTION

It is desirable to properly lubricate the moving components in an internal combustion engine and provide hydraulic power. Typically, oil pumps used in engines are operably associated with the crankshaft of the engine (e.g., direct driven, chain driven, gear driven and/or the like) and have relatively simple fixed pressure regulation systems. While these systems are generally adequate, there are some disadvantages. For example, there is not much control of the actual discharge pressure relative to the pressure needed by the engine under certain/given operating conditions. By way of a non-limiting example, currently available pump technology typically provides high oil pressure at all engine operating conditions, where a lower oil pressure may be adequate at some of those engine conditions.

In commonly-assigned U.S. Pat. No. 6,896,489, the entire specification of which is expressly incorporated herein by reference, a mechanical hydraulic arrangement is shown for providing control of a variable displacement vane pump. This provides for a more optimized control of engine oil pressure. However, it is yet desirable to provide some further control depending on engine needs and/or variables.

Accordingly, there exists a need for a method of control and system for control of a variable flow pump (e.g., vane pump) by the use of an engine control unit which actuates a solenoid for directly and/or indirectly controlling the flow rate of a variable flow pump.

SUMMARY OF THE INVENTION

In accordance with the general teachings of the present invention, a control system for a variable flow hydraulic pump is provided, wherein electrical input from an engine control unit actuates a solenoid for controlling the engine oil pressure to the desired level under a wide range of operating conditions.

In accordance with a first embodiment, a pump system including a control system for controlling a variable flow pump for controlling oil flow and oil pressure in a hydraulic circuit in an engine is provided, comprising: (1) a pump member; (2) an actuating member capable of controlling the flow generated by the pump member; and (3) a solenoid valve system including a solenoid valve portion and a pressure regulator valve portion, wherein the solenoid valve system is operably associated with the pump, wherein the pressure regulator valve portion is operably associated with the actuating member for selectively controlling the flow generated by the pump member.

In accordance with a second embodiment, a pump system including a control system for controlling a variable flow pump for controlling oil flow and oil pressure in a hydraulic circuit in an engine is provided, comprising: (1) a pump member; (2) an actuating member capable of controlling the flow generated by the pump member; (3) a solenoid valve system including a solenoid valve portion and a pressure regulator valve portion, wherein the solenoid valve system is operably associated with the pump member, wherein the pressure regulator valve portion is operably associated with the actuating member for selectively controlling the flow generated by the pump member; and (4) an electronic control unit operably associated with the solenoid valve portion, wherein the electronic control unit is selectively operable to provide an input control signal to the solenoid valve portion for controlling oil flow and oil pressure.

In accordance with a third embodiment, a pump system including a control system for controlling a variable flow pump for controlling oil flow and oil pressure in a hydraulic circuit in an engine is provided, comprising: (1) a pump member; (2) an actuating member capable of controlling the flow generated by the pump member, wherein the pump member is a vane pump and the actuator member is at least part of an eccentric ring of the vane pump, wherein the vane pump and the eccentric ring operate to control the flow of oil to the engine; (3) a solenoid valve system including a solenoid valve portion and a pressure regulator valve portion, wherein the solenoid valve system is operably associated with the pump member, wherein the pressure regulator valve portion is operably associated with the actuating member for selectively controlling the flow generated by the pump member; and (4) an electronic control unit operably associated with the solenoid valve portion, wherein the electronic control unit is selectively operable to provide an input control signal to the solenoid valve portion for controlling oil flow and oil pressure.

In accordance with one aspect of the present invention, an electronic control unit is operably associated with the solenoid valve portion, wherein the electronic control unit is selectively operable to provide an input control signal to the solenoid valve portion for controlling oil flow and oil pressure.

In accordance with one aspect of the present invention, the electronic control unit is operably associated with and monitors the pressure in a portion of the hydraulic circuit, wherein the electronic control unit generates an input signal to the solenoid valve portion in response to pressure conditions in the portion of the hydraulic circuit for controlling flow generated by the pump member.

In accordance with one aspect of the present invention, the electronic control unit monitors engine conditions selected from the group consisting of engine speed, engine temperature, engine load, and combinations thereof, and selectively adjusts oil pressure based thereon.

In accordance with one aspect of the present invention, the pump member is a vane pump and the actuator member is at least part of an eccentric ring of the vane pump, wherein the vane pump and the eccentric ring operate to control the flow of oil to the engine.

In accordance with one aspect of the present invention, the solenoid valve system is disposed within a housing member.

In accordance with one aspect of the present invention, the solenoid valve system is operable to regulate a supply pressure down to a control pressure.

In accordance with one aspect of the present invention, the solenoid valve system is selectively operable to regulate a supply pressure down to a control pressure in response to the current supplied to the solenoid valve portion.

In accordance with one aspect of the present invention, a first biasable member is operably associated with the actuating member, wherein the first biasable member is selectively operable to cause the actuating member to control the flow generated by the pump member.

In accordance with one aspect of the present invention, the pressure regulator valve portion comprises a flow control spool valve, wherein the flow control spool valve is operably associated with the solenoid valve portion, wherein the flow control spool valve is selectively operable to control flow to the actuating member.

In accordance with one aspect of the present invention, a second biasable member is operably associated with a first end of the flow control spool valve, wherein the second biasable member maintains pressure on the flow control spool valve during regular operation, and provides return pressure on the flow control spool valve in the presence of low supply pressure conditions.

In accordance with one aspect of the present invention, the oil pressure can be controlled at a plurality of locations in the hydraulic circuit by applying the oil pressure to the actuating member.

In accordance with one aspect of the present invention, the plurality of locations is selected from the group consisting of a point within the pump, a point of the pump discharge to the engine, a point within the engine main oil gallery, and combinations thereof.

In accordance with one aspect of the present invention, the oil pressure can be supplied to the solenoid valve system from a plurality of locations in the hydraulic circuit.

In accordance with one aspect of the present invention, the plurality of locations is selected from the group consisting of a point within the pump, a point of the pump discharge to the engine, a point within the engine main oil gallery, and combinations thereof.

In accordance with one aspect of the present invention, the solenoid valve portion can be selectively actuated by a technique selected from the group consisting of electrical actuation, hydraulic pressure actuation, and combinations thereof.

In accordance with one aspect of the present invention, the solenoid valve system comprises a variable force solenoid.

A further understanding of the present invention will be had in view of the description of the drawings and detailed description of the invention, when viewed in conjunction with the subjoined claims.

BRIEF DESCRIPTION OF THE DRAWINGS

The present invention will become more fully understood from the detailed description and the accompanying drawings, wherein.

DETAILED DESCRIPTION OF THE INVENTION

The following description of the invention is merely exemplary in nature and is in no way intended to limit the invention, its application, or uses.

Figure 1:
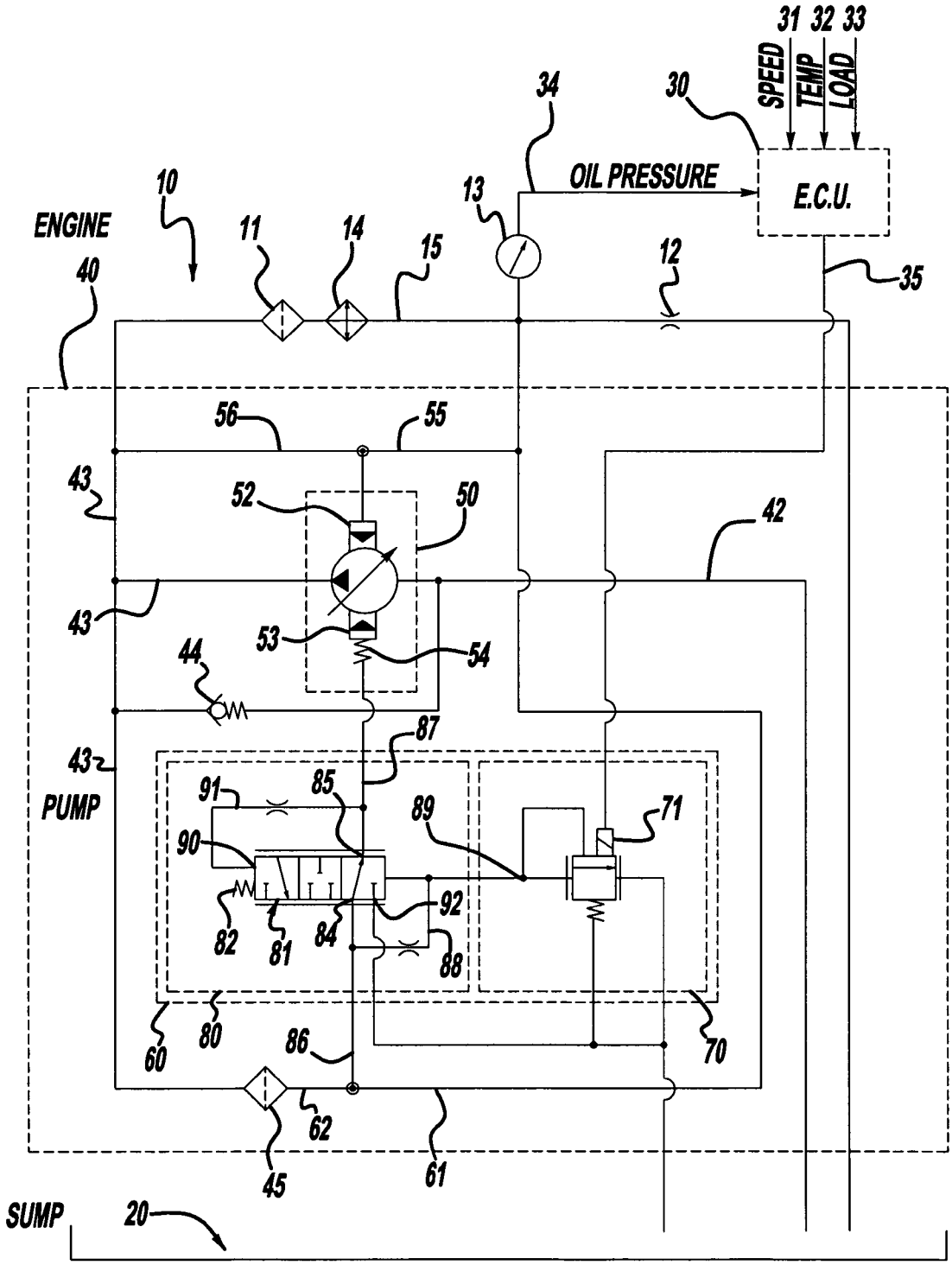
FIG. 1 illustrates a hydraulic schematic of a variable displacement pump system, in accordance with the general teachings of the present invention.
Figure 2:
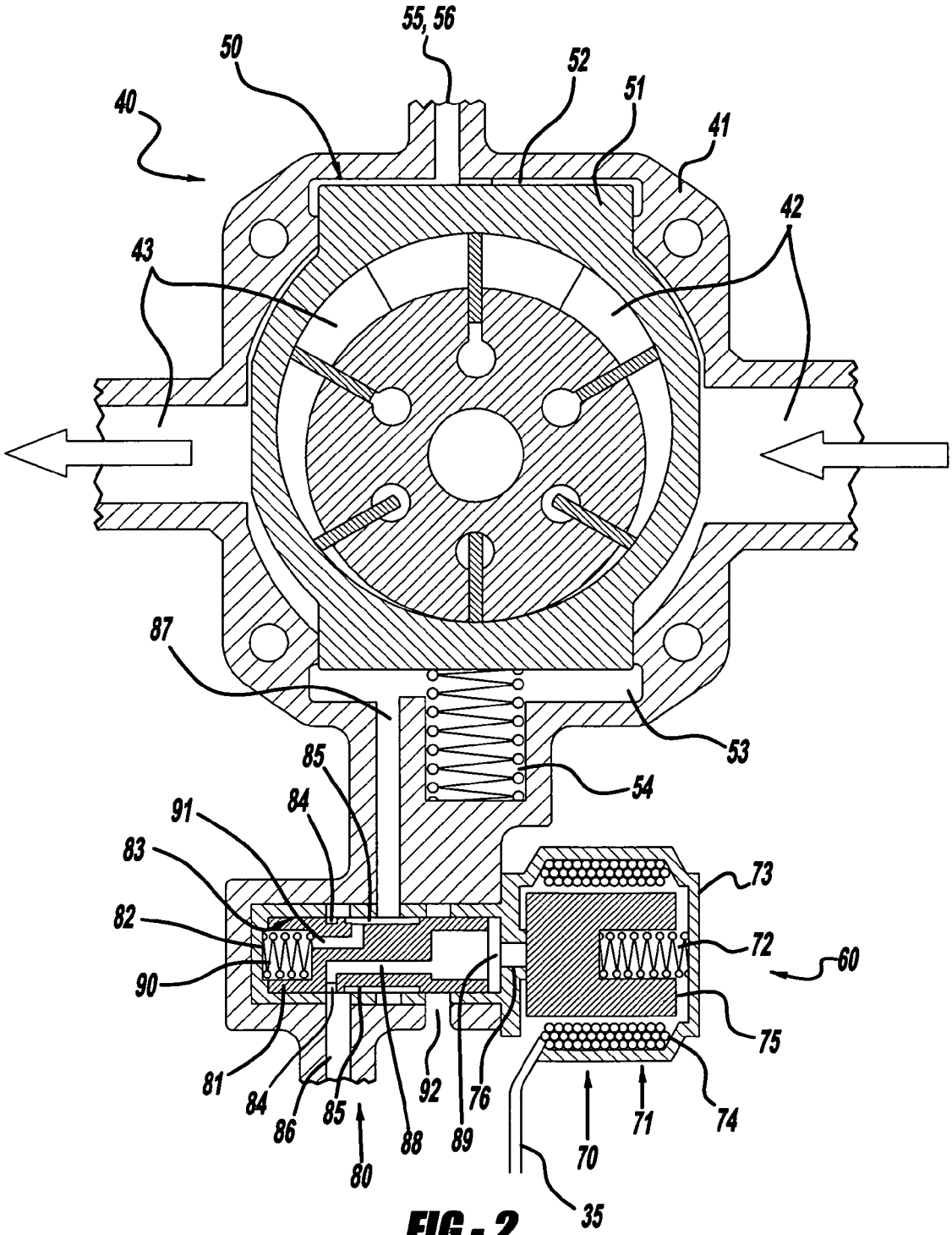
FIG. 2 illustrates a sectional view of a pump element, in accordance with a first embodiment of the present invention.

Referring to drawings generally, and specifically to FIGS. 1 and 2, a system and method is provided for controlling an oil pump 40 with either a variable displacement pump element or a variable output pump element. It should be appreciated that other types of pump systems can be used in the present invention, such as but not limited to other types of vane pumps, gear pumps, piston pumps, and/or the like.

In the engine system of the present invention, there is at least a lubrication circuit 10, an oil sump 20, an engine control unit (i.e., ECU) or computer 30, and an oil pump 40 which draws oil from the oil sump 20 and delivers it at an elevated pressure to the lubrication circuit 10.

In accordance with one aspect of the present invention, the lubrication circuit 10 includes at least an oil filter 11 and journal bearings 12 supporting the engine's crankshaft, connecting rods and camshafts, and can contain a variable pressure transducer 13 and/or an oil cooler 14. The lubrication circuit 10 can also optionally contain items such as piston cooling jets, chain oilers, variable cam timing phasers, and cylinder de-activation systems, as are generally known in the art.

In accordance with one aspect of the present invention, the ECU 30 includes electrical inputs for the measured engine speed 31, engine temperature 32, and engine load, torque or throttle 33. The ECU 30 can also have an electrical input for the measured oil pressure 34 from the transducer 13. The ECU 30 also has an output 35 for an electrical control signal to the oil pump 40.

In accordance with one aspect of the present invention, the oil pump 40 includes a housing 41 which contains a suction passage 42, and a discharge passage and manifold 43. The oil pump 40 can also include a pressure relief valve 44 and/or an internal oil filter 45 for cleaning the discharge oil for use inside the oil pump 40.

In accordance with one aspect of the present invention, the oil pump 40 contains a variable flow pump element 50, which is further comprised of a positionable element, such as an eccentric ring 51, the position of which determines the theoretical flow rate discharged by the pump element 50 at a given drive speed, and which forms in conjunction with the housing 41 two control chambers on opposing sides of the eccentric ring 51, which contain fluid of controlled pressure for the intended purpose of exerting a control force on an area of the eccentric ring 51. The first chamber, e.g., the decrease chamber 52, contains pressure applied to the eccentric ring 51 to decrease the flow rate of the variable flow pump element 50, and the second chamber, e.g., the increase chamber 53, contains pressure applied to the eccentric ring 51 to increase the flow rate of the variable flow pump element 50. There is additionally a spring 54 positioned between the housing 41 and the eccentric ring 51 which applies a force to the eccentric ring 51 to increase the flow rate of the variable flow pump element 50. The decrease chamber 52 can be supplied with oil pressure from either the oil pump discharge manifold 43 via channel 56 or some other point downstream in the lubrication circuit 10 (e.g., usually from the main oil gallery 15) via channel 55.

In accordance with one aspect of the present invention, the oil pump 40 also contains a solenoid valve module 60 which includes a solenoid valve stage 70 and a pressure regulator valve stage 80.

In accordance with one aspect of the present invention, the solenoid valve stage 70 includes a solenoid 71, a spring 72, and a housing 73. The solenoid 71 includes a coil of electrical wire 74 and a ferrous armature 75, configured so that an electric current passing through the coil 74 generates an electromagnetic field which moves the armature against the compression spring 72 and opens the valve hole 76 in the housing 73, thereby allowing fluid to flow through it.

In accordance with one aspect of the present invention, the pressure regulator valve stage 80 includes a spool 81, a spring 82, and an area defining a bore 83 (i.e., in housing 73) for radial containment of the spool 81. The spool 81 has in its outer diameter two annular grooves, a spool supply port 84 which is in continuous fluid communication with the housing supply port 86, and a spool control port 85 which is in continuous fluid communication with the housing control port 87. Housing supply port 86 can be supplied with oil pressure from either the oil pump discharge manifold 43 via filter 45 and channel 62 or some other point downstream in the lubrication circuit 10 (e.g., usually from the main oil gallery 15) via channel 61. The spool supply port 84 is also in continuous fluid communication with fluid chamber 89 via the restrictive orifice hole 88. The spool control port 85 is also in continuous fluid communication with fluid chamber 90 via hole 91. The spool 81 is positioned axially in bore 83 by the resultant force of the control pressure in fluid chamber 90, the spring 82, and the supply pressure in fluid chamber 89.

Figure 3:
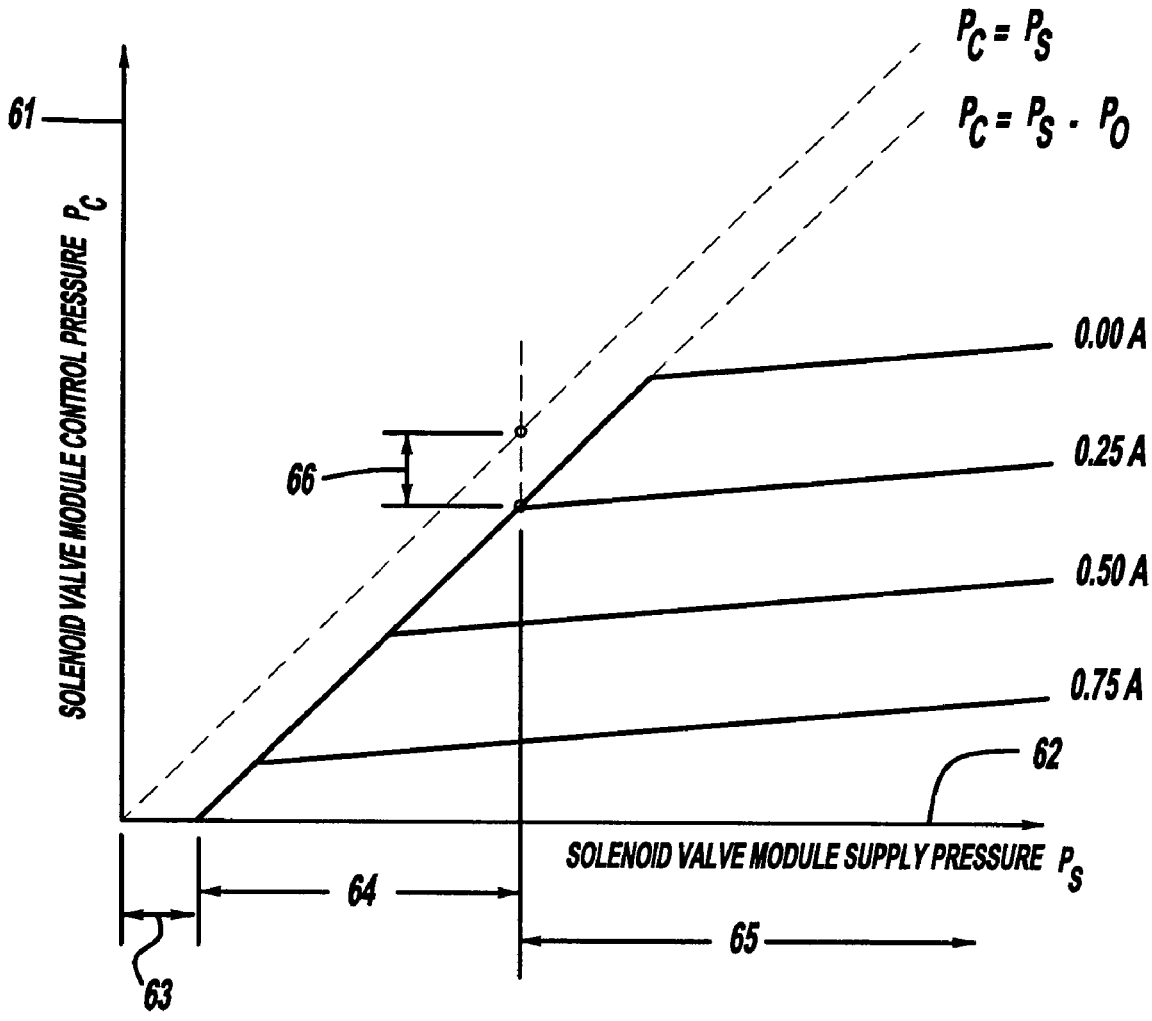
FIG. 3 illustrates a graph showing the performance characteristics of a solenoid valve module, in accordance with a second embodiment of the present invention.

A change in the axial position of spool 81 will increase or reduce the area open for fluid communication between spool control port 85 and both housing supply port 86 and housing drain port 92, which has the resultant effect of regulating the control pressure (e.g., see reference 61 in FIG. 3) in spool control port 85 and passage 87 to some level lower than the pressure in supply passage 86 (e.g., see reference 62 in FIG. 3). The lower pressure level is determined by the spring rate and assembled length of spring 82 and the area at each end of spool 81. The lower pressure level is supplied to the increase chamber 53 through passage 87 where it acts on the eccentric ring 51 along with the spring 54 to increase the flow rate of the variable flow pump element 50. The lower pressure level serves as a reference force for the eccentric ring 51, along with spring 54, so that if the pressure in the decrease chamber 52 exceeds them, the pressure in the decrease chamber 52 will move the eccentric ring 51 to reduce the pump flow, which will reduce the pressure in the decrease chamber 52 until it is in force equilibrium with the pressure in increase chamber 53 and the spring 54.

Conversely, if the pressure in the decrease chamber 52 is lower than the reference pressure, the pressure in the increase chamber 53 and the spring 54 will move the eccentric ring to increase the pump flow. The pressure regulator valve stage 80 is shown in accordance with one aspect of the present invention to have a total of three fluid communication ports, i.e., the supply port 84, the control port 86 and the drain port 92.

FIG. 3 graphically illustrates the solenoid valve control pressure 61 (e.g., in port 85 and passage 87) on the vertical axis as a function of both the supply pressure 62 (e.g., in port 84 and passage 86) on the horizontal axis and the current to the solenoid valve 70 through the ECU electrical output line/wire 35.

In accordance with one aspect of the present invention, the curves have three characteristic zones, e.g., the zero control pressure zone 63, the offset control pressure zone 64, and the variable control pressure zone 65. The zero control pressure zone 63 is identical for all currents to the solenoid valve 70. The transition from the offset control pressure zone 64 to the variable control pressure zone 65 occurs at decreasing supply pressure as the current to the solenoid valve 70 is increased. The pressure regulating stage 80 has a characteristic offset 66 between the supply pressure 62 and the control pressure 61. Without being bound to a particular theory of the operation of the present invention, it is believed that this offset 66 is the reason that there is a zero control pressure zone 63 because the supply pressure 62 has not yet reached the level of the offset 66, and the control pressure 61 cannot be negative (e.g., a vacuum).

At low supply pressure 62, the spring 82 holds the spool 81 to the right in dominance over the supply pressure 62 acting on the end of spool 81 from fluid chamber 89 via restrictive passage 88, thereby closing the area of fluid communication between the supply port 84 and the control port 86 and opening the area of fluid communication between the control port 86 and the drain port 92. As the supply pressure 62 increases, it will move the spool 81 to the left against the spring 82 and will eventually close the area of fluid communication between the control port 86 and the drain port 92, at which point the pressure can begin to build in the control port 86 via leakage between the spool 81 and the housing bore 83 from the supply port 84 to the control port 86. As the supply pressure 62 continues to increase, it will further move the spool 81 to the point where the area of fluid communication between the supply port 84 and the control port 86 is opened, allowing the control pressure 61 to rise to the level of the supply pressure 62. At that point, the spring force 82 together with the control pressure force in fluid chamber 90, e.g., communicated via passage 91, will overcome the supply pressure force in fluid chamber 89 and move the spool 81 to the right. The spool 81 will reach an equilibrium position where the control pressure force is reduced from the supply pressure force by the amount of the force applied to the spool 81 by the spring 82, which thereby determines the characteristic offset 66 in the offset control pressure zone 64.

As the supply pressure 62 continues to increase, the pressure in fluid chamber 89 will follow, and it can eventually overcome the spring 72 holding the solenoid armature 75 against the housing 73, thereby opening valve hole 76 and attenuating further increase of the supply pressure 62. When the valve hole 86 is open, and there is a restricted fluid flow through the restrictive passage 88, the pressure in fluid chamber 89 is no longer equal to, but is reduced from, the supply pressure 62 at the supply port 84. When the ECU 30 selectively routes current through the solenoid coil 74 via electrical output 35, the solenoid armature 75 is also forced to the right against the spring 72 by the resulting electromagnetic field, which will also serve to reduce the pressure in fluid chamber 89 and thereby the control pressure 61. The spring 72 provides a proportional characteristic to the solenoid valve system, such that increasing current provides increasing valve opening, e.g., a variable force solenoid. The control pressure 61 will maintain its characteristic offset 66 to the pressure in fluid chamber 89, which is reduced from the supply pressure 62 because of the restricted flow through passage 88.

In accordance with one aspect of the present invention, the oil pump 40 can be operated without the ECU 30, because the solenoid valve module 60 performs some pressure regulation activity even without electrical power, as shown in the third operating zone 65 in FIG. 3.

In accordance with one aspect of the present invention, the oil pump 40 can be operated by the ECU 30 in an open loop control mode because the ECU 30 can be reasonably certain of the oil pressure in the lubrication circuit 10 as a function of current to the solenoid 71 through electrical output 35 from an internal "look up" table in the ECU 30, even without measuring the oil pressure through transducer 13.

In accordance with one aspect of the present invention, the oil pump 40 can be operated by the ECU 30 in a closed loop mode to actively control the oil pressure by adjusting its electrical signal to the solenoid 71 through electrical output 35 according to software logic control programmed into the ECU 30 and the oil pressure measured in the lubrication circuit 10 by transducer 13. The ECU 30 can also anticipate increasing oil demand in the lubrication circuit 10. This can be accomplished by simultaneously actuating the pump and an oil-consuming engine subsystem, such as variable cam timing or cylinder deactivation. The ECU 30, through the present invention, would also have the capability of selectively activating certain pressure-sensitive engine subsystems, by selecting a higher or lower oil pressure for the lubrication circuit 10 depending on any known condition, including but not limited to the measured engine speed 31, engine temperature 32, and/or engine load 33.

In accordance with one aspect of the present invention, the oil pump 40 can be operated in a mixed control mode by combining elements of the previous three control modes. By way of a non-limiting example, it could be useful to allow the oil pump 40 to regulate itself without ECU control at conditions outside the range of normal parameters, and then to use open loop control to quickly achieve oil pressure near the desired value, and then use closed loop control to exactly achieve the desired oil pressure.

The description of the invention is merely exemplary in nature and, thus, variations that do not depart from the scope of the invention are intended to be within the scope of the invention. Such variations are not to be regarded as a departure from the spirit and scope of the invention.

What is claimed is:

1. A pump system including a control system for controlling a variable flow pump for controlling oil flow and oil pressure in a hydraulic circuit in an engine, comprising:

a pump member;

an eccentric ring disposed in a housing, said eccentric ring capable of controlling the flow generated by the pump member;

a decrease chamber formed in said pump system by said eccentric ring and said housing, said decrease chamber in continuous fluid communication with the discharge of said pump member and operably associated with said eccentric ring such that as the amount of fluid in said decrease chamber increases and the amount of pressure in said decrease chamber increases, said eccentric ring moves in said housing, and the displacement of said pump system will decrease;

a channel extending through said pump system, said channel operable for placing said discharge of said pump member in continuous fluid communication with said decrease chamber;

an increase chamber formed in said pump system by said eccentric ring and said housing, and operably associated with said eccentric ring such that as the amount of fluid in said increase chamber increases and the amount of pressure in said increase chamber increases, said eccentric ring moves in said housing, and the displacement of said pump system will increase;

a pressure regulator valve stage in fluid communication with said increase chamber and providing a reference pressure to said increase chamber that acts against the pressure in said decrease chamber to determine the position of said eccentric ring; and a solenoid valve stage for hydraulically actuating said pressure regulator valve stage.

2. The invention according to claim 1, further comprising an electronic control unit operably associated with the solenoid valve stage portion, wherein the electronic control unit is selectively operable to provide an input control signal to the solenoid valve stage portion for controlling oil flow and oil pressure.

3. The invention according to claim 2, wherein the electronic control unit is operably associated with and monitors the pressure in a portion of the hydraulic circuit, wherein the electronic control unit generates an input signal to the solenoid valve stage portion in response to pressure conditions in the portion of the hydraulic circuit for controlling flow generated by the pump member.

4. The invention according to claim 2, wherein the electronic control unit monitors engine conditions selected from the group consisting of engine speed, engine temperature, engine load, and combinations thereof, and selectively adjusts oil pressure based thereon.

5. The invention according to claim 2, wherein the pressure regulator valve stage is operable to regulate a supply pressure down to a control pressure in response to the current supplied to the solenoid valve stage portion.

6. The invention according to claim 1, wherein the pump member is a vane pump and the eccentric ring is part of the vane pump, wherein the vane pump and the eccentric ring operate to control the flow of oil to the engine.

7. The invention according to claim 1, further comprising a first biasable member operably associated with the eccentric ring, wherein the first biasable member is selectively operable to cause the eccentric ring to control the flow generated by the pump member.

8. The invention according to claim 1, wherein the pressure regulator valve stage portion comprises a flow control spool valve, wherein the flow control spool valve is operably associated with the solenoid valve stage portion, wherein the flow control spool valve is operable to control flow to the eccentric ring.

9. The invention according to claim 8, further comprising a second biasable member operably associated with a first end of the flow control spool valve, wherein the second biasable member maintains pressure on the flow control spool valve during regular operation, and provides return pressure on the flow control spool valve in the presence of low supply pressure conditions.

10. The invention according to claim 1, wherein the oil pressure is controlled at a plurality of locations in the hydraulic circuit by applying the oil pressure to the eccentric ring.

11. The invention according to claim 10, wherein the plurality of locations is selected from the group consisting of a point within the pump, a point of the pump discharge to the engine, a point within the engine main oil gallery, and combinations thereof.

12. The invention according to claim 1, wherein oil pressure can be supplied to the pressure regulator stage from a plurality of locations in the hydraulic circuit.

13. The invention according to claim 12, wherein the plurality of locations is selected from the group consisting of a point within the pump, a point of the pump discharge to the engine, a point within the engine main oil gallery, and combinations thereof.

14. The invention according to claim 1, wherein the solenoid valve portion can be selectively actuated by a technique selected from the group consisting of electrical actuation, hydraulic pressure actuation, and combinations thereof.

15. The invention according to claim 1, wherein the solenoid valve stage comprises a variable force solenoid.

16. A pump system including a control system for controlling a variable flow pump for controlling oil flow and oil pressure in a hydraulic circuit in an engine, comprising:

a pump member;

an eccentric ring disposed in a housing, said eccentric ring capable of controlling the flow generated by the pump member;

a decrease chamber formed in said pump system by said eccentric ring and said housing, said decrease chamber in continuous fluid communication with the discharge of said pump member and operably associated with said eccentric ring such that as the amount of fluid in said decrease chamber increases and the amount of pressure in said decrease chamber increases, said eccentric ring moves in said housing, and the displacement of said pump system will decrease;

a channel extending through said pump system, said channel operable for placing said discharge of said pump member in continuous fluid communication with said decrease chamber for providing pressurized fluid to said decrease chamber;

an increase chamber formed in said pump system by said eccentric ring and said housing, and operably associated with said eccentric ring such that as the amount of fluid in said increase chamber increases and the amount of pressure in said increase chamber increases, said eccentric ring moves in said housing, and the displacement of said pump system will increase;

a solenoid valve system including a solenoid valve stage portion and a pressure regulator valve stage portion, said pressure regulator valve stage portion in fluid communication with said increase chamber, and said pressure regulator valve stage portion in fluid communication with the discharge of said pump member;

a port for providing fluid communication between said solenoid valve stage portion and said pressure regulator valve stage portion;

wherein the solenoid valve system is operably associated with the pump member;

wherein the pressure regulator valve stage portion is operably associated with the eccentric ring for selectively controlling the flow generated by the pump member by providing a reference pressure to said increase chamber that acts against the pressure in said decrease chamber to determine the position of said eccentric ring; and an electronic control unit operably associated with the solenoid valve stage portion, wherein the electronic control unit is selectively operable to provide an input control signal to the solenoid valve stage portion for controlling oil flow and oil pressure and said solenoid valve stage portion is operable for at least partially controlling the amount of fluid flow through said port.

17. The invention according to claim 16, wherein the electronic control unit is operably associated with and monitors the pressure in a portion of the hydraulic circuit, wherein the electronic control unit generates an input signal to the solenoid valve stage portion in response to pressure conditions in the portion of the hydraulic circuit for controlling flow generated by the pump member.

18. The invention according to claim 16, wherein the solenoid valve system is operable to regulate a supply pressure down to a control pressure in response to the current supplied to the solenoid valve portion.

19. The invention according to claim 16, wherein the oil pressure is controlled at a plurality of locations in the hydraulic circuit by applying the oil pressure to the eccentric ring and wherein the oil pressure is supplied to the solenoid valve system from a plurality of locations in the hydraulic circuit.

20. A pump system including a control system for controlling a variable flow pump for controlling oil flow and oil pressure in a hydraulic circuit in an engine, comprising:

a pump member;

an eccentric ring disposed in a housing, said eccentric ring capable of controlling the flow generated by the pump member;

wherein the pump member is a vane pump and the eccentric ring is at least part of the vane pump, wherein the vane pump and the eccentric ring operate to control the flow of oil to the main oil gallery of the engine;

a decrease chamber formed in said pump system by said eccentric ring and said housing, said decrease chamber in continuous fluid communication with the discharge of said pump member and operably associated with said eccentric ring such that as the amount of fluid in said decrease chamber increases and the amount of pressure in said decrease chamber increases, said eccentric ring moves in said housing, and the displacement of said pump system will decrease;

a channel extending through said pump system, said channel operable for placing said discharge of said pump member in continuous fluid communication with said decrease chamber for providing pressurized fluid to said decrease chamber;

an increase chamber formed in said pump system by said eccentric ring and said housing, and operably associated with said eccentric ring such that as the amount of fluid in said increase chamber increases and the amount of pressure in said increase chamber increases, said eccentric ring moves in said housing, and the displacement of said pump system will increase;

a solenoid valve system including a solenoid valve stage portion and a pressure regulator valve stage portion, said pressure regulator valve stage portion in fluid communication with said increase chamber, and said pressure regulator valve stage portion in fluid communication with the discharge of said pump member;

a port for providing fluid communication between said solenoid valve stage portion and said pressure regulator valve stage portion;

wherein the solenoid valve system is operably associated with the pump member;

wherein the pressure regulator valve stage portion is operably associated with the eccentric ring for selectively controlling the flow generated by the pump member by providing a reference pressure to said increase chamber that acts against the pressure in said decrease chamber to determine the position of said eccentric ring; and an electronic control unit operably associated with the solenoid valve portion, wherein the electronic control unit is selectively operable to provide an input control signal to the solenoid valve portion for controlling oil flow and oil pressure, and said solenoid valve stage portion is operable for at least partially controlling the amount of fluid flow through said port.

* * * * *

UNITED STATES PATENT AND TRADEMARK OFFICE

CERTIFICATE OF CORRECTION

PATENT NO. : 7,726,948 B2
APPLICATION NO. : 11/287099
DATED : June 1, 2010
INVENTOR(S) : Douglas G. Hunter et al.

It is certified that error appears in the above-identified patent and that said Letters Patent is hereby corrected as shown below:

Title page, page 2,
Item [56], References Cited, FOREIGN PATENT DOCUMENTS, "DE 32 30 432 2/1987" should be -- DE 32 30 432 2/1984 --.

Signed and Sealed this

Twenty-third Day of November, 2010

David J. Kappos

David J. Kappos
*Director of the United States Patent and Trademark Office*